US005332407A

United States Patent [19]

Herbstman

[11] Patent Number: 5,332,407

[45] **Date of Patent: * Jul. 26, 1994**

[54] DIESEL FUEL ADDITIVE PROVIDING CLEAN UP DETERGENCY OF FUEL INJECTORS

[75] Inventor: Sheldon Herbstman, New City, N.Y.

[73] Assignee: Texaco Inc., White Plains, N.Y.

[ * ] Notice: The portion of the term of this patent subsequent to Aug. 10, 2010 has been disclaimed.

[21] Appl. No.: 962,550

[22] Filed: Oct. 19, 1992

[51] Int. Cl.[5] ..... C10L 1/10

[52] U.S. Cl. ..... 44/419; 44/418; 44/434; 44/438; 44/447; 44/505; 44/628; 44/641; 210/696; 564/133; 564/197; 524/476; 252/51.5 R; 252/170; 252/380

[58] Field of Search ..... 44/418, 419, 434, 438, 44/447, 505, 628, 641; 210/696; 564/133, 197; 524/476; 252/170, 51.5 R, 380

[56] References Cited

U.S. PATENT DOCUMENTS

| | | | |
|---|---|---|---|
| 4,125,382 | 11/1978 | O'Brien | 44/444 |
| 4,755,189 | 7/1980 | Feldman | 44/447 |
| 4,808,195 | 3/1986 | Ambrogio | 44/444 |
| 4,933,485 | 6/1990 | Buckley, III | 252/51.5 R |

*Primary Examiner*—Robert L. Stoll
*Assistant Examiner*—Valerie Fee
*Attorney, Agent, or Firm*—Christopher Nicastri

[57] ABSTRACT

A diesel fuel composition comprising a major portion of a middle distillate fuel oil and a minor portion, effective to clean deposits from diesel fuel injectors, of a diesel fuel detergent comprising the reaction product of:

(a) a 4-alkyl-2-morpholinone represented by the formula:

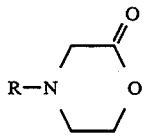

in which R represents a monovalent aliphatic radical having from 1 to 10 carbon atoms, and (b) an alkylphenoxypolyoxyalkylene amine represented by the formula:

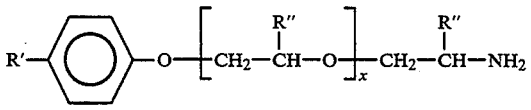

in which R′ represents a hydrocarbyl radical having from 4 to 30 carbon atoms, x has a value from 5 to 50, and R″ represents a methyl radical or a mixture of hydrogen and methyl radicals.

A method of cleaning diesel fuel injectors is also provided.

28 Claims, No Drawings

DIESEL FUEL ADDITIVE PROVIDING CLEAN UP DETERGENCY OF FUEL INJECTORS

BACKGROUND OF THE INVENTION

1. Field of the Invention

This invention relates to diesel fuel and, more particularly, to a diesel fuel composition containing a detergent additive which actively cleans deposits from dirty diesel fuel injectors.

2. Description of Related Information

Diesel fuel impurities can arise from a variety of sources. They can form during refining or they can develop as a result of the oxidation which occurs during storage. Such impurities tend to be both soluble and insoluble materials having higher molecular weights and boiling points than the fuel, and which manifest themselves in the engine as colors or gums. Impurities can also be introduced into the fuel during handling or during storage from corrosion of storage vessels. Impurities can even take the form of other additives intentionally introduced by the manufacturer to solve or prevent some particular problem or improve the fuel itself, such as, for example, anti-oxidants, rust preventatives, etc.

Regardless of the source, any of these impurities can cause deposits to form in the fuel system of compression ignition engines, and, in particular, in the fuel injectors. These deposits coat or adhere to injector parts and cause injector sticking, injector tip fuel metering passage fouling, nozzle hole plugging, leakage past critical surfaces, and delayed injection (and, hence, delayed start of combustion). These problems, in turn, result in significantly increased engine noise, smoke emissions, misfiring, low temperature or cold start problems, and idle roughness, and decreased power output and fuel economy.

It is believed that these engine problems are the result of long ignition delays, significantly contributed to by deposits, causing an excessively rapid pressure rise in the cylinder once combustion does occur. Recent evidence suggests that the long delay provides the time for certain chemical reactions to take place in the atomized fuel charge prior to ignition, resulting in products which burn exceedingly rapidly once combustion begins, thereby causing the undesirable rapid pressure rise, and the resultant problems.

It would therefore be desirable to prevent the deposits caused by impurities or to remove such deposits once they have formed. The present invention provides a diesel fuel composition which contains a detergent additive which is effective to remove deposits from dirty diesel fuel injectors and to keep these injectors clean. These and other objects of the present invention are discussed in more detail below.

SUMMARY OF THE INVENTION

The present invention provides a diesel fuel composition comprising a major portion of a middle distillate fuel oil and a minor portion, effective to clean deposits from diesel fuel injectors, of a diesel fuel detergent comprising the reaction product of:

(a) a 4-alkyl-2-morpholinone represented by the formula:

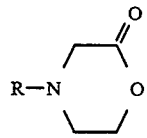

in which R represents a monovalent aliphatic radical having from 1 to 10 carbon atoms, and (b) an alkylphenoxypolyoxyalkylene amine represented by the formula:

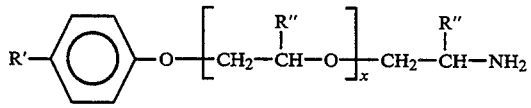

in which R′ represents a hydrocarbyl radical having from 4 to 30 carbon atoms, x has a value from 5 to 50, and R″ represents a methyl radical or a mixture of hydrogen and methyl radicals.

Another aspect of the present invention is a method of cleaning deposits from diesel engine fuel injectors comprising the step of operating a diesel engine with a fuel composition comprising a major portion of a middle distillate fuel oil and a minor portion, effective to clean deposits from diesel fuel injectors, of the diesel fuel additive described herein.

DETAILED DESCRIPTION OF THE INVENTION

Applicant has discovered a class of detergent additive compounds which are effective to clean deposits from dirty diesel engine fuel injectors. Unexpectedly, this class of detergent additives has been found to be effective at relatively low concentrations in diesel fuel.

The detergent additive of the present invention is the reaction product of a 4-alkyl-2-morpholinone and an alkylphenoxypolyoxyalkylene amine.

The 4-alkyl-2-morpholinone used to prepare the additive of the instant invention can be represented by the formula:

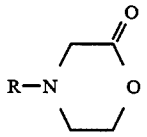

in which R represents a monovalent aliphatic radical having from 1 to about 10 carbon atoms. Preferably, R is an alkyl radical having from 1 to 4 carbon atoms and most preferably having from 1 to 3 carbon atoms. Specific compounds which fall within the scope of this formula include 4-methyl-2-morpholinone, 4-ethyl-2-morpholinone and 4-isopropyl-2-morpholinone. Of these compounds, 4-methyl-2-morpholinone is particularly preferred. These compounds can be made by any suitable means. See, for example, U.S. Pat. No. 3,073,822.

The alkylphenoxypolyoxyalkylene amine reactant can be represented by the formula:

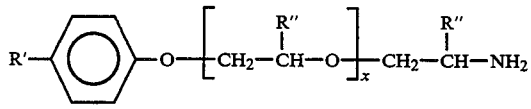

in which R′ is a hydrocarbyl radical having from about 4 to about 30 carbon atoms, x represents a number from about 4 to about 50, and R″ represents a methyl radical or a mixture of hydrogen and methyl radicals. Preferably, R′ represents a monovalent aliphatic radical having from about 6 to about 24 carbon atoms, and more preferably an aliphatic radical having from about 8 to about 20 carbon atoms. In a particularly preferred embodiment, R′ is an aliphatic radical having from about 9 to about 18 carbon atoms. Preferably, x is a number from about 6 to about 30, and, most preferably, x is a number from about 10 to about 20.

As indicated above, the alkylphenoxypolyoxyalkylene amine reactant contains an internal radical represented by the formula:

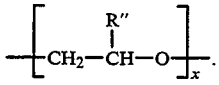

Preferably R″ is a methyl group, such that the internal radical is a propylene oxide radical. However, R″ can be a mixture of hydrogen and methyl radicals such that the internal radical will comprise a mixture of propylene oxide and ethylene oxide radicals. The mixture of propylene oxide and ethylene oxide radicals can form either a random or block copolymer. When the internal radical represents both propylene oxide and ethylene oxide radicals, the ratio of propylene oxide:ethylene oxide radicals employed may range from about 2:3 to about 999:1. Preferably the range of molar ratios of propylene oxide to ethylene oxide is from about 7:3 to 999:1.

The 4-alkyl-2-morpholinone reactant and the alkylphenoxypolyoxyalkylene amine reactant are reacted in about a 1:1 mole ratio. While other mole ratios are contemplated, no significant advantage is realized in departing from about equimolar reaction ratios. The reactants can be reacted at temperatures between room temperature and 130° C., and reaction times will depend upon reaction temperature. For example, at 130° C., the reaction will take between 1 and 4 hours, while at 30° C., the reaction will take between 1 and 30 hours. Preferably, the reaction is conducted at about 130° C. for approximately 2 hours.

The additive reaction product of the invention can be represented by the formula:

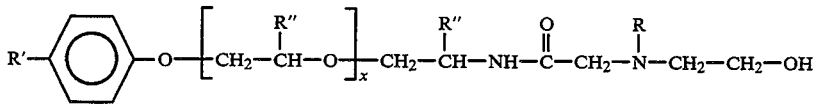

where R, R′, R″ and x are defined as they are in the description of the reactants above.

The following examples are provided to illustrate the preparation of the additive of the invention.

EXAMPLE I

A. Preparation of Propylene Oxide Adduct of Nonyl Phenol

Fifteen pounds of nonyl phenol and 226.8 grams of 45 percent aqueous potassium hydroxide were charged into a 10-gallon kettle. The reactor was then purged with pre-purified nitrogen. The reactor was heated to 110° C., while maintaining a nitrogen purge, and the initiator sodium hydroxide was dried to a water content of less than 0.15 percent using both vacuum and nitrogen stripping. 13.5 moles of propylene oxide (53.4 pounds) was then reacted at 110°–115° C. at 60 psig over an 8.5 hour period. The reaction mixture was then digested for two hours to an equilibrium pressure and purged with nitrogen for 15 minutes. The alkaline product was then neutralized at 95° C. by stirring for two hours with 612 grams Magnesol 30/40 TM, adsorbent which was added in an aqueous slurry. Di-t-butyl p-cresol (9.3 grams) was then added to stabilize the product against oxidation. The neutralized product was then vacuum stripped to a minimum pressure at 110° C., nitrogen stripped, and filtered. Properties of the finished product are given in Table I below.

TABLE I

| Properties | |
|---|---|
| Acid no., mg KOH/g | 0.001 |
| Hydroxyl no. mg KOH/g | 59.2 |
| Unsaturation, meg/g | 0.036 |
| Water, wt. % | 0.04 |
| pH in 10:6 isopropanol-water | 8.3 |
| Color, Pt—Co | 50 |
| Sodium, ppm | 0.5 |
| Potassium, ppm | 3.5 |
| Viscosity, 77° F., μ | 123 |

B. Preparation of Nonylphenoxypolyoxypropylene Amine 1.0 pound per hour of the product of Example 1A, 1.0 pound per hour of ammonia and 50 liters per hour of hydrogen were added to a tubular reactor filled with 1250 milliliters of a nickel catalyst. The reactor conditions were 2000 psig and 210° C. The crude reactor effluent was charged into a clean dry kettle, then nitrogen stripped to 75° C. and then placed under a vacuum and heated to 100° C. The product had the following analysis:

| | meq/gram |
|---|---|
| Total acetylated | 1.09 |
| Total amine | 1.05 |
| Primary amine | 1.05 |

C. Preparation of the Reaction Product of 4-Methyl-2-Morpholinone and Nonylphenoxypolyoxypropylene Amine The following were charged into a 2-liter, three-necked flask equipped with a thermometer, stirrer, and nitrogen outlet: 1099.8 grams of nonylphenoxypolyoxypropylene amine (the product of Example 1B) and 132.8 grams of 4-methyl-2-morpholinone. The mixture was heated to 130° C. for two hours. The resulting product had the following analysis:

| | meq/gram |
|---|---|
| Total acetylated | 1.09 |
| Total amine | 1.002 |

and can be represented by the formula:

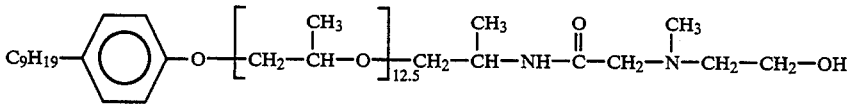

EXAMPLE II

Example I was repeated, except that 7.5 moles of propylene oxide, instead of 13.5 moles, were reacted with nonylphenol in making Preparation A.

EXAMPLE III

Example I was repeated, except that 19.5 moles of propylene oxide, instead of 13.5 moles, were reacted

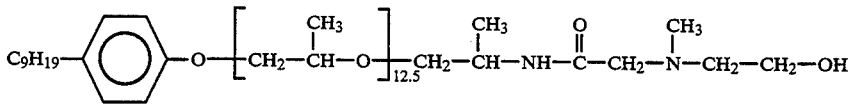

with nonylphenol in making Preparation A.

EXAMPLE IV

Example I was repeated, except that the morpholinone reacted was 4-isopropyl-2-morpholinone instead of the 4-methyl analog.

EXAMPLE V

Example I was repeated, except that 13.8 moles of a mixture of ethylene oxide and propylene oxide, instead of 13.5 moles of propylene oxide, were reacted with nonylphenol in making Preparation A.

In its broadest embodiment, the diesel fuel composition of the present invention comprises a major portion of a middle distillate fuel oil boiling in the range from 340° F. to 620° F., and a minor portion of the diesel fuel detergent of the present invention effective to remove deposits from dirty diesel fuel injectors. The amount of the diesel fuel detergent which is effective to clean dirty diesel fuel injectors can easily be determined by those in the petroleum industry. Of course, it is most cost effective to use as little of the additive as will be effective to clean deposits from dirty fuel injectors. One method suitable for this determination is the injector clean up test detailed below. The diesel fuel detergent of the invention is effective at low concentrations of between about 10 parts per thousand barrels of base fuel stock (PTB)(33 parts per million(ppm)), preferably 50 PTB (165 ppm), more preferably 75 PTB (248 ppm) and most preferably 90 PTB (297 ppm), and about 300 PTB (990 ppm), preferably 150 PTB (495 ppm), more preferably 125 PTB (247 ppm) and most preferably 100 PTB (330 ppm). The additives of the present invention may be added to diesel fuel by any means known in the art for adding small quantities of additives to a base fuel.

The additive of the present invention can advantageously be employed in a remedial method for cleaning deposits from dirty diesel fuel injectors. In accordance with this method, a diesel engine with dirty fuel injectors is operated using a fuel containing the diesel fuel additive of the present invention, in the amounts described above. The engine is preferably operated in this manner for at least about 3 hours.

The diesel fuel detergent additives of the present invention are effective in very small concentrations and, therefore, for consumer end use it is desirable to package them in dilute form. Thus, a concentrate of the additives of the present invention can be provided comprising a diluent e.g., xylene, toluene, kerosine or heavier oil including either diesel fuel or lubricating fractions such as SNO 600 or SNO 2000, and about 1 to about 50 wt. % of the additive.

An additive of the present invention, represented by the formula was evaluated at 100 PTB (330 ppm) in a typical diesel fuel using the Daimler Benz OM-616 Engine test, as compared to the same fuel which was not additized. The diesel fuel used to test the additive of the present invention was a typical middle distillate having a boiling point range from about 340° F. to about 650° F., and a sulfur content of about 0.17%.

Daimler Benz OM-616 Engine

The Daimler Benz OM-616 Engine is equipped with pintle type injectors and is typically used in light duty vehicles. The engine has the following specifications:

| Daimler Benz OM-616 Engine | |
|---|---|
| No. of Cylinders | 4 |
| Bore | 79.0 mm |
| Stroke | 61.0 mm |
| Nozzle Opening Pressure | 115–125 atms |
| Injection Timing | 24° BTDC |

Description of Test

New nozzles are flowed with air, using a nozzle flow testing rig to ISO 4010 standards. The nozzles are assembled, set to the correct opening pressure and then fitted to the engine. The engine is then operated for three hours to dirty-up the injectors. During the test, the engine is operated under the following conditions:

| Test Conditions | |
|---|---|
| Engine Speed | 4000 rpm |
| Engine Power | 12 kW |

-continued

| Test Conditions | |
|---|---|
| Test Duration | 3 hours |
| Air Inlet Temperature | 18–25° C. |
| Coolant Outlet Temperature | 85° C. |
| Oil Sump Temperature | 110–115° C. |

At the end of the dirty-up test, the injectors are removed and are re-flowed. The injectors are reassembled, reinstalled in the engine and run for three more hours using an additive treated fuel to clean-up the deposits. The nozzles are re-flowed at the end of the clean-up test.

The results are expressed in terms of percentage of clean engine flow. For each cylinder, a mathematical mean of the flow at lift points 0.1 mm, 0.2 mm, 0.3 mm and 0.4 mm was calculated. The figure reported in Table II is the average of the results for the four cylinders of the engine.

The results of the test are provided in Table II.

TABLE II

| Run | 1 | 2 |
|---|---|---|
| Fuel | base fuel plus additive of the present invention | unadditized base fuel |
| Percentage of clean engine flow rate | 43.2% | 26% |

These results indicate that after the "dirtied up" engine was run with an unadditized fuel, the injectors flowed only 26% of the air that the clean injectors flowed. On the other hand, after the "dirtied up" engine was run with a fuel composition of the present invention, the injectors flowed 43.2% of the air that the clean injectors flowed. Thus, the additive of the present invention showed excellent clean-up detergency: the injectors cleaned via the process of the present invention flowed 66% more air, measured as a percentage of the flow of the injectors which were run with unadditized base fuel.

I claim:

1. A diesel fuel composition comprising a major portion of a middle distillate fuel oil and a minor portion, effective to clean deposits from diesel fuel injectors, of a diesel fuel detergent comprising the reaction product of:

(a) a 4-alkyl-2-morpholinone represented by the formula:

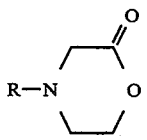

in which R represents a monovalent aliphatic radical having from 1 to 10 carbon atoms, and (b) an alkylphenoxypolyoxyalkylene amine represented by the formula:

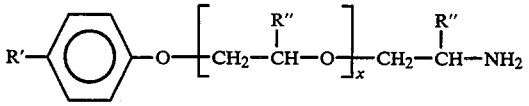

in which R′ represents a hydrocarbyl radical having from 4 to 30 carbon atoms, x has a value from 4 to 50, and R″ represents a methyl radical or a mixture of hydrogen and methyl radicals.

2. The diesel fuel composition according to claim 1 wherein the minor portion of diesel fuel detergent is effective to reduce the formation of deposits on diesel fuel injectors.

3. The diesel fuel composition according to claim 1 in which R represents a monovalent aliphatic radical having from 1 to 3 carbon atoms.

4. The diesel fuel composition according to claim 1 in which R represents a methyl radical.

5. The diesel fuel composition according to claim 1 in which R′ represents a monovalent aliphatic radical having from 6 to 24 carbon atoms.

6. The diesel fuel composition according to claim 1 in which R′ represents a monovalent aliphatic radical having from 8 to 20 carbon atoms.

7. The diesel fuel composition according to claim 1 in which x has a value from about 6 to 20.

8. The diesel fuel composition according to claim 1 in which R″ represents a methyl radical.

9. The diesel fuel composition according to claim 1 in which R″ represents a mixture of methyl radicals and hydrogen such that the internal alkylene oxide radical of the alkylphenoxypolyoxyalkylene amine, represented by

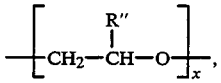

comprises a mixture of propylene oxide and ethylene oxide in a molar ratio of about 2:3 to about 999:1 propylene oxide:ethylene oxide.

10. The diesel fuel composition according to claim 9 in which the molar ratio of propylene oxide to ethylene oxide is about 7:3 to about 999:1.

11. The diesel fuel composition according to claim 1 wherein the diesel fuel detergent is present in an amount of about 10 PTB to about 300 PTB.

12. The diesel fuel composition according to claim 1 wherein the diesel fuel detergent is present in an amount of about 50 PTB to about 150 PTB.

13. The diesel fuel composition according to claim 1 wherein the diesel fuel detergent is present in an amount of about 75 PTB to about 125 PTB.

14. A diesel fuel composition comprising a major portion of a middle distillate fuel oil and between 75 PTB and 100 PTB of a diesel fuel detergent comprising the reaction product of:

(a) a 4-alkyl-2-morpholinone represented by the formula:

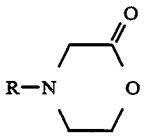

in which R represents a methyl radical;

(b) an alkylphenoxypolyoxyalkylene amine represented by the formula:

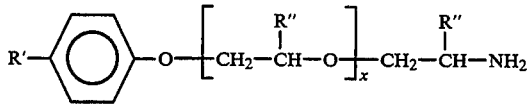

in which R′ represents a hydrocarbyl radical having from 8 to 20 carbon atoms, x has a value from 6 to 20, and R″ represents a methyl radical or a mixture of hydrogen and methyl radicals.

15. A method for cleaning deposits from diesel engine fuel injectors comprising operating the diesel engine using a fuel composition comprising a major portion of a middle distillate fuel oil and a minor portion, sufficient to provide fuel injector clean up detergency, of an additive comprising the reaction product of:

(a) a 4-alkyl-2-morpholinone represented by the formula:

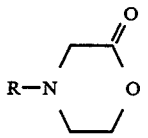

in which R represents a monovalent aliphatic radical having from 1 to 10 carbon atoms, and (b) an alkylphenoxypolyoxyalkylene amine represented by the formula:

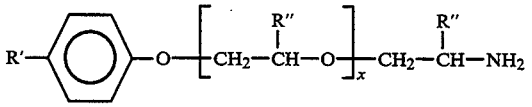

in which R′ represents a hydrocarbyl radical having from 4 to 30 carbon atoms, x has a value from 4 to 50, and R″ represents a methyl radical or a mixture of hydrogen and methyl radicals.

16. The method according to claim 15 where the diesel engine is operated for at least 3 hours.

17. The method according to claim 15 in which R represents a monovalent aliphatic radical having from 1 to 3 carbon atoms.

18. The method according to claim 15 in which R represents a methyl radical.

19. The method according to claim 15 in which R′ represents a monovalent aliphatic radical having from 6 to 24 carbon atoms.

20. The method according to claim 15 in which R′ represents a monovalent aliphatic radical having from 8 to 20 carbon atoms.

21. The method according to claim 15 in which x has a value from about 6 to 20.

22. The method according to claim 15 in which R″ represents a methyl radical.

23. The method according to claim 15 in which R″ represents a mixture of methyl radicals and hydrogen such that the internal alkylene oxide radical of the alkylphenoxypolyoxyalkylene amine, represented by

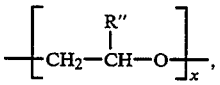

comprises a mixture of propylene oxide and ethylene oxide in a molar ratio of about 2:3 to about 999:1 propylene oxide:ethylene oxide.

24. The method according to claim 23 in which the molar ratio of propylene oxide to ethylene oxide is about 7:3 to about 999:1.

25. The method according to claim 15 wherein the diesel fuel detergent is present in an amount of about 10 PTB to about 300 PTB.

26. The method according to claim 15 wherein the middle distillate fuel oil is combined with about 50 PTB to about 150 PTB of the diesel fuel detergent.

27. The method according to claim 15 wherein the middle distillate fuel oil is combined with about 75 PTB to about 125 PTB of the diesel fuel detergent.

28. The method according to claim 15 wherein the middle distillate fuel oil is combined with about 75 PTB to about 100 PTB of the diesel fuel detergent.

* * * * *